US011180292B2

(12) United States Patent
Benoit-Gonin et al.

(10) Patent No.: US 11,180,292 B2
(45) Date of Patent: Nov. 23, 2021

(54) METHOD OF MANUFACTURING A TAMPER-EVIDENT CLOSURE

(71) Applicant: Obrist Closures Switzerland GmbH, Reinach (CH)

(72) Inventors: Claude Benoit-Gonin, Odenas (FR); Jean-Yves Rognard, Marcy-sur-Anse (FR)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 16/254,090

(22) Filed: Jan. 22, 2019

(65) Prior Publication Data

US 2019/0152658 A1 May 23, 2019

Related U.S. Application Data

(63) Continuation of application No. 15/026,484, filed as application No. PCT/EP2014/052564 on Feb. 10, 2014, now Pat. No. 10,287,067.

(30) Foreign Application Priority Data

Oct. 1, 2013 (GB) ..... 1317407

(51) Int. Cl.
*B65D 47/08* (2006.01)
*B65D 55/02* (2006.01)

(52) U.S. Cl.
CPC ..... *B65D 47/0804* (2013.01); *B65D 55/024* (2013.01); *B65D 2401/30* (2020.05)

(58) Field of Classification Search
CPC ..... B65D 47/0804; B65D 55/024; B65D 2401/30; B65D 2401/50; B65D 47/103
USPC ..... 215/48, 250, 253, 254, 256
See application file for complete search history.

(56) References Cited

U.S. PATENT DOCUMENTS

| | | | |
|---|---|---|---|
| 5,427,260 | A | 6/1995 | Mueller et al. |
| 5,772,076 | A | 6/1998 | Juk et al. |

FOREIGN PATENT DOCUMENTS

| | | | |
|---|---|---|---|
| EP | 1582475 | A1 | 10/2005 |
| EP | 1892194 | A1 | 2/2008 |
| EP | 2213584 | A1 | 8/2010 |
| JP | 2006232359 | A | 9/2006 |
| JP | 2012046209 | A | 3/2012 |
| WO | 0041943 | A1 | 7/2000 |
| WO | 2008089785 | A1 | 7/2008 |
| WO | 2009022892 | A1 | 2/2009 |

OTHER PUBLICATIONS

Great Britain Intellectual Property Office, Search Report Issued in Application GB1317407.3, dated Feb. 13, 2014, 4 pages.
ISA European Patent Office, International Search Repod Issued and Written Opinion Issued in Application No. PCT/EP2014/052564, dated Sep. 15, 2014, WIPO, 10 pages.
State Intellectual Property Office of the People's Republic of China, Office Action and Search Report Issued in Application No. 202010326381.8, dated May 25, 2021, 23 pages (Submitted with Partial Translation).

*Primary Examiner* — Anthony D Stashick
*Assistant Examiner* — Raven Collins
(74) *Attorney, Agent, or Firm* — McCoy Russell LLP

(57) ABSTRACT

A method of manufacturing a tamper-evident closure, comprising the steps of: forming a body having a base and a lid; and inserting a dispensing member and a tamper-evident member into the body.

18 Claims, 14 Drawing Sheets

METHOD OF MANUFACTURING A TAMPER-EVIDENT CLOSURE

CROSS REFERENCE TO RELATED APPLICATIONS

The present application is a continuation of U.S. patent application Ser. No. 15/026,484, entitled "A METHOD OF MANUFACTURING A TAMPER-EVIDENT CLOSURE" filed on Mar. 31, 2016. U.S. patent application Ser. No. 15/026,484 is a U.S. National Phase of International Application No. PCT/EP2014/052564, entitled "A METHOD OF MANUFACTURING A TAMPER-EVIDENT CLOSURE," filed on Feb. 10, 2014. International Application No. PCT/EP2014/052564 claims priority to Great Britain Application No. 1317407.3 filed on Oct. 1, 2013. The entire contents of the above-identified applications are hereby incorporated by reference in their entirety for all purposes.

The present disclosure relates generally to the manufacture of closures and particularly to the manufacture of tamper-evident closures.

Tamper-evident closures are widely used and include some means of indicating that a closure has been opened at least once. Such closures can be fabricated in a variety of different ways.

The present disclosure seeks to provide improvements in or relating to the method by which a tamper-evident closure is fabricated.

According to a first aspect of the present disclosure there is provided a method of manufacturing a tamper-evident closure, comprising the steps of: forming a body having a base and a lid; and inserting a dispensing member and a tamper-evident member into the body The base and lid may be formed integrally, for example with an integral hinge connecting them together.

The lid may be movable between an open position and a closed position. The body may be formed with the lid in an open or partially open position.

The tamper-evident member and/or the dispensing member may be introduced into the body with the lid in an open position.

In some embodiments, prior to inserting the tamper-evident member and/or the dispensing member into the body the lid may be closed onto the base for example the tamper-evident member and/or the dispensing member are introduced after the lid has been closed.

The body may be formed with the lid in a closed position. The tamper-evident member and/or the dispensing member may be inserted into the body with the lid in the closed position. Alternatively the lid may be opened before introduction.

In some embodiments, the tamper-evident member engages the lid when introduced into the body. For example the member may secure the lid in the closed position. For this purpose the lid and member may be provided with co-operating features (such as a hook and a ledge) so that they engage upon insertion of the member. The engagement may then be used to cause the tamper evidence to operate, for example by causing the member to be broken or separated upon opening of the lid.

In some embodiments the member is a double ring structure, with two rings frangibly connected. Upon assembly, one of the rings engages in the lid and one engages in the base so that upon first opening the rings are pulled apart.

In some embodiment the tamper-evident member is inserted before the dispensing member and the dispensing member may be used to secure the tamper-evident member in position. In other embodiments the dispensing member is inserted first.

The dispensing member may comprise or include a spout or the like.

The method may further comprise a slitting step, for example to form one or more frangible lines on the body, tamper-evident member or dispensing member. For example a frangible line may be formed towards the free end of a base sidewall to form a tamper-evident band that will activate if an attempt is made to remove the closure from an associated container.

In some embodiments the tamper-evident member and/or the dispensing member are introduced through the base, for example from its end opposite the lid and through a sidewall.

The present disclosure also provides a method of manufacturing a tamper-evident closure, comprising the steps of: a) forming a body having a base and a lid; b) inserting a tamper-evident member into the body, and c) inserting a dispensing member into the body, in which the tamper-evident member secures or holds the lid in a closed position prior to step c).

In this method the tamper-evident member secures the lid in a closed position with respect to the base before the dispensing member is inserted. In other words, the lid and base are held in a closed position during assembly of the dispensing member.

The present disclosure also provides a tamper-evident dispensing closure manufactured using a method as described herein.

The present disclosure also provides a closure as described herein in combination with a container.

Different aspects and embodiments of the disclosure may be used separately or together.

Particular aspects of the present disclosure are set out in the accompanying independent and dependent claims. Features of the dependent claims may be combined with the features of the independent claims as appropriate, and in combination other than those explicitly set out in the claims.

The present disclosure will now be more particularly described, by way of example, with reference to the accompanying drawings.

DETAILED DESCRIPTION

Figure 2:
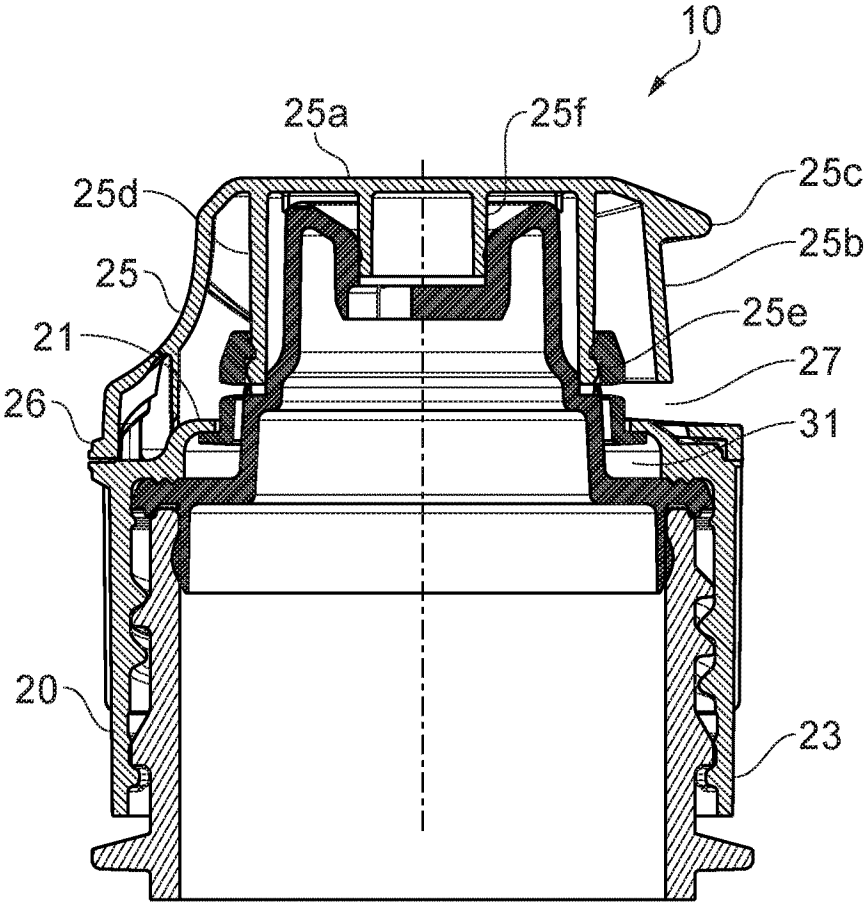
FIG. 2 is a section of the closure of FIG. 1.
Figure 1:
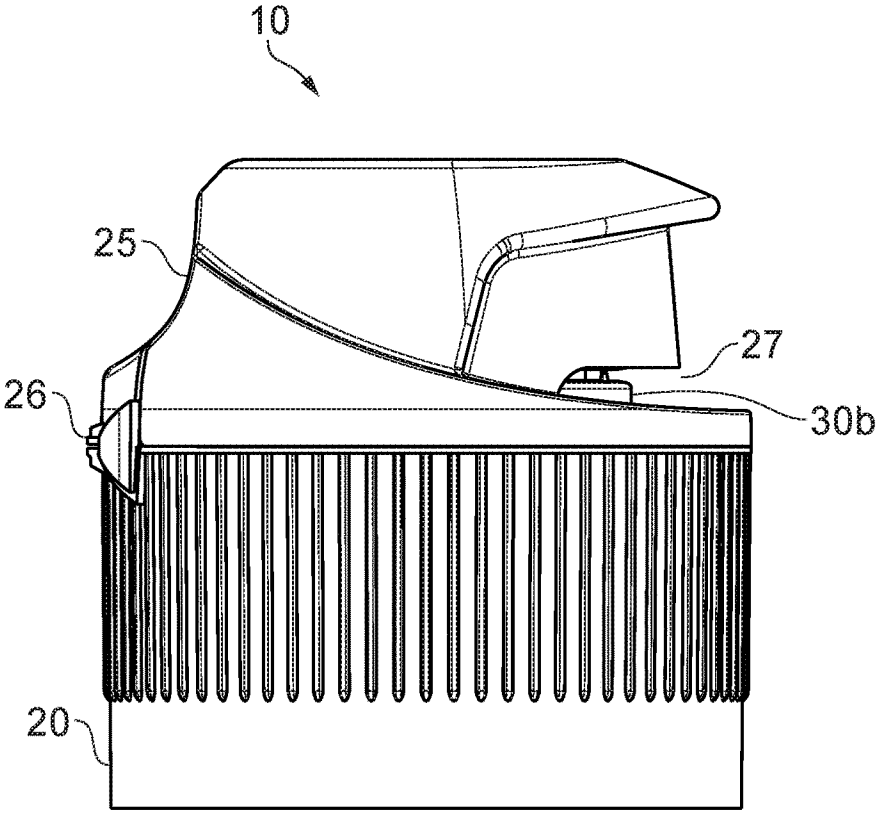
FIG. 1 is a side elevation of a tamper-evident closure suitable for manufacture using the method of the present disclosure.
Figure 6:
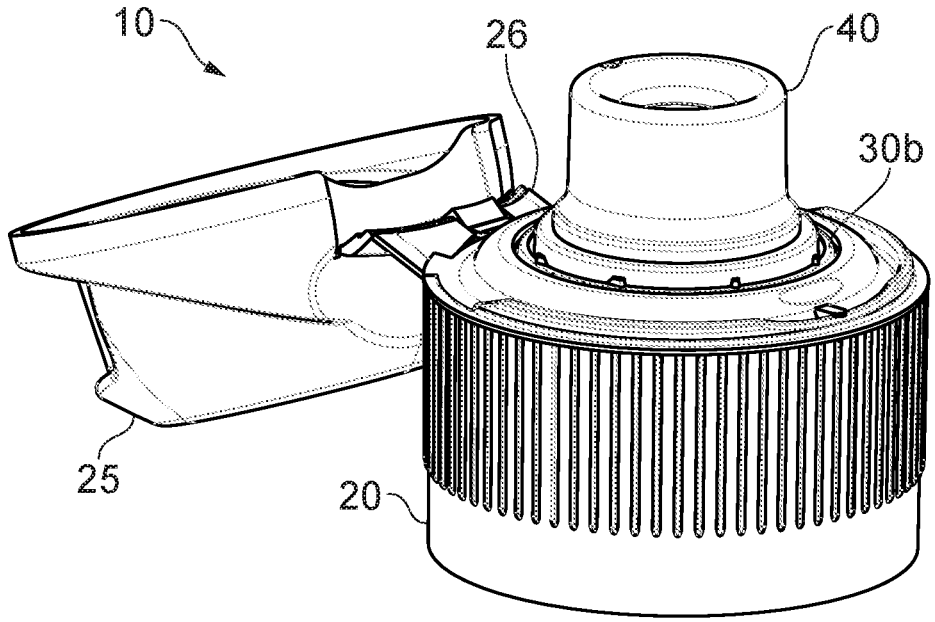
FIG. 6 is a perspective view of the closure of FIGS. 1 and 2 shown in an opened position.

FIGS. 1, 2 and 6 show a closure 10 being an embodiment of which the method of the present disclosure is suitable.

The closure 10 comprises a body having a base 20 and a lid 25. The lid has a top surface 25*a* and a projection 25*c* on one side to aid gripping and opening of the lid 25.

Figure 4:
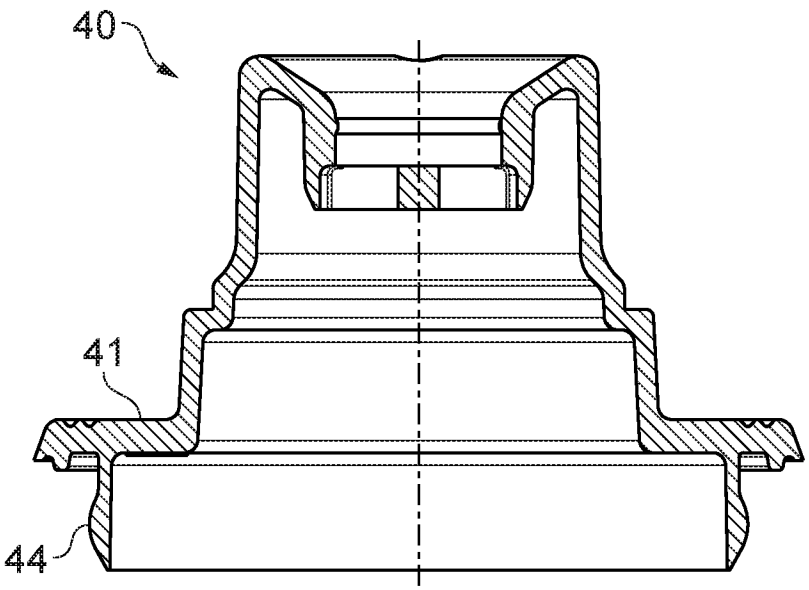
FIG. 4 is a section of the spout of FIG. 3.
Figure 3:
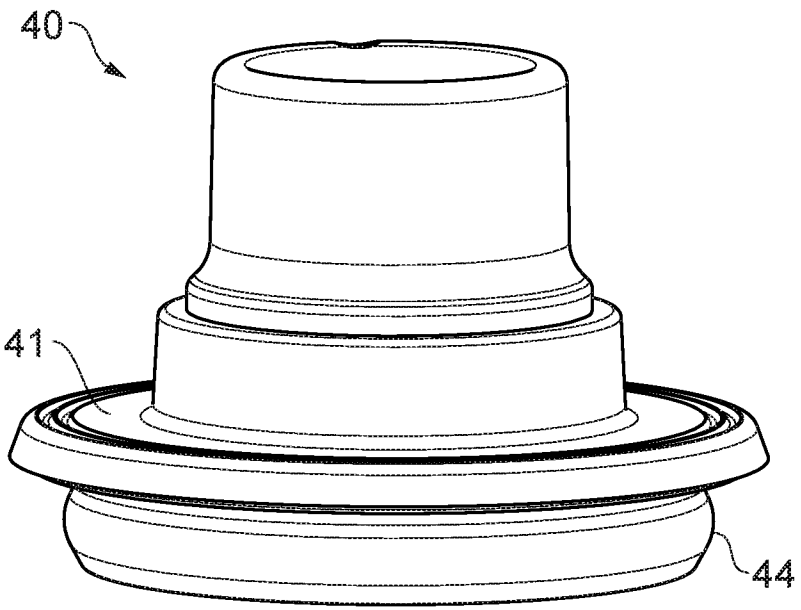
FIG. 3 is a side perspective view of a dispensing spout forming part of the closure of FIGS. 1 and 2.

Referring also to FIGS. 3 and 4, within the closure 10 is a spout or dispensing member 40 which is a separate member fitted inside the base 20 and lid 25.

The base 20 and lid 25 are pivoted together by a hinge 26.

The lid 25 has an outer skirt 25*b* and an annular inner skirt 25*d* which depend from the top surface 25*a* and presses against part of the spout 40 so as to provide a seal. Further, the lid 25 includes an annular projection 25*f* depending from the underside of top surface 25*a* and which takes the form of a bore seal to seal against the inner surface of the spout 40 to prevent leakage of the contents of the container when the lid is in the closed position.

The spout 40 includes a flange 41 which projects radially outward from the side of the spout 40 at approximately the same axial level, when assembled with the base and/or lid, as the parting plane between the underside of the lid 25 and the upper surface of the base 20. Furthermore, the skirt 25*d* of the lid 25 has a projection 25*e*. This projection 25*e* projects radially outwards at the lower end of the skirt 25*d*. A gap 27 is left between the lower end of the side skirt 25*b* in a region approximately opposite the hinge 26 and the upper surface of the base 20. A void or pocket 31 is provided between the spout 40 and the base 20.

The spout 40 also includes a bore seal 44 which depends from the flange 41 and seals against the radially inner surface of an associated container (see FIG. 2).

Figure 5:
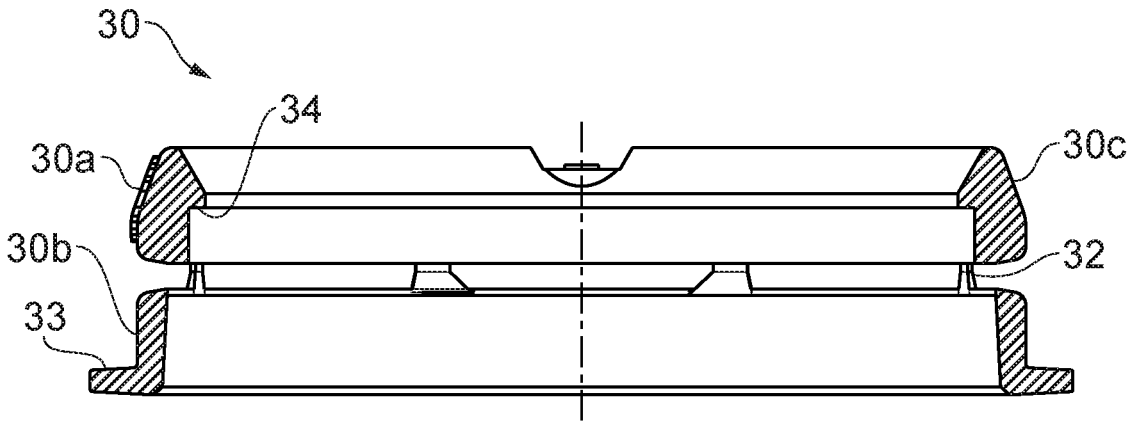
FIG. 5 is a section of a tamper-evident member forming part of the closure of FIGS. 1 and 2.

Referring also to FIG. 5, a tamper-evident member 30 which takes the form of a separate element having an upper ring 30*a* and a lower ring 30*b* connected together by frangible connections 32 is assembled with the closure 10. Upon assembly, the tamper-evident member 30 fits between the base and the lid and radially outward of the spout 40. The tamper-evident member 30 includes an upper projection 34 which projects radially inwards and a lower flange 33 which projects radially outwards.

When the tamper-evident member 30 is assembled with the closure 10 the upper projection 34 engages with the projection 25*e* provided on the radially inner surface of the side skirt 25*b* of the lid 25. Further, the lower projection 33 engages under a terminal sidewall portion 21. In this manner, the lid cannot be opened without breaking the frangible connections 32. The components are all shaped to allow initial installation; for example the upper ring 30*a* has an angled surface 30*c* so that the ring 30*a* can pass over the projection 25*e* during assembly. The upper projection 34 includes an undercut, on the side opposite to the side having the angled surface, which engage with the projection 25*e* to prevent the projections from passing over one another following installation.

Furthermore, the closure 10 includes a tamper-evident band 23 at the lower end of the base 20 which operates in a similar manner to well-known tamper-evident drop members.

Referring now to FIGS. 7 to 13 there is shown a further embodiment of a closure 110 which is suitable for fabrication using a method according to the present disclosure.

The closure 110 is connectable to a container neck.

The closure 110 comprises a body 111, a spout insert 120 and a tamper-evident member insert 101.

The body 111 comprises a base 112 and a lid 114.

The base 112 comprises a generally cylindrical side wall 116 having at one end a tamper-evident annular band 117 connected thereto by a plurality of frangible bridges 118.

The side wall 116 terminates at its end opposite the band 117 with an annular shoulder 116*c* which extends radially inwards.

The turret-like lid 114 is connected to the free end of the shoulder 116*c* via a hinge arrangement generally indicated 132.

The interior of the base side wall 116 comprises internal screw thread formations 116*a* for engaging corresponding external screw thread formations on a container neck. The interior of the side wall 116 further comprises an annular retention bead 116*b* positioned below a second shoulder 116*d* in the sidewall 116.

The interior of the band 117 comprises a segmented retention bead 117*a* for engagement under a locking bead on a container neck so that if the closure is unscrewed the band 117 will remain on a container neck.

The lid 114 comprises a top plate 134 from which depends a curved outer sidewall 135; an inner skirt 125*b* depends from the underside of the top plate, radially inwards of the outer wall 135 and a spigot 136 depends from the underside of the centre of the plate 134, radially inwards of the inner skirt 125*b*. The free end of the lid sidewall 135 includes a window 108 (which could be, for example, a material thinning or an opening).

Opposite the hinge 132 the lid 114 includes a small peak 138 used to lift the lid and flip it open with respect to the base 112.

The spout 120 comprises a generally cylindrical lower portion 150, a generally cylindrical central portion 151 and a generally frusto conical upper portion 152.

The lower portion 150 comprises an annular external sealing bead 156. In use, the portion 150 enters the bore of the container neck such that the sealing bead 156 seals against its inner surface.

The central retention portion 151 comprises a plurality of radially outwardly extending retention spokes 160.

The upper portion 152 comprises a curved, generally frusto conical outer surface defining a spout. At the end of the spout side wall opposite the central portion 151 is a cylindrical terminal portion 170. An inclined annular orifice wall 172 extends inwards from the free end of the portion 170 and from it an annular wall 173 depends; the wall 173 defines an orifice 174.

The separate spout 120 is received into the body 111 as part of method described in more detail below with reference to FIGS. 14 to 21. The spokes 160 abut against the shoulder 116*d* and engage under the projection 116*b* to retain the spout in the base. The spigot 136 enters through the wall 173 to close the orifice 174.

Figure 13:
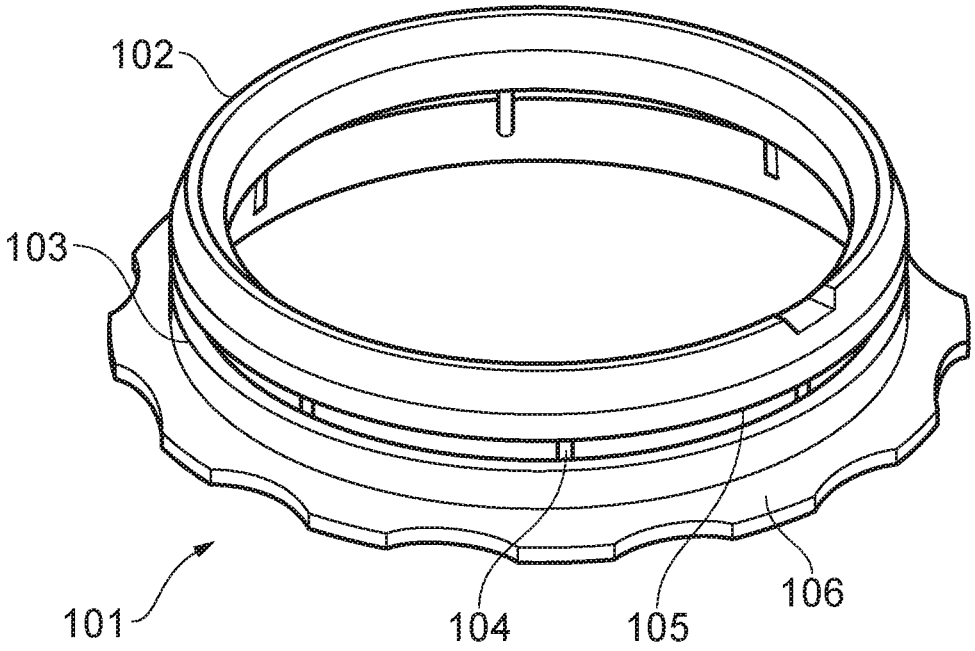
FIG. 13 is a perspective view of a tamper-evident member forming part of the closure of FIGS. 7 to 12 and shown in an unbroken condition.

A tamper-evident member 101 is provided for the closure and is shown in more detail in FIG. 13.

The member 101 takes the form of a separate element having an upper ring 102 and a lower ring 103 connected together by frangible connections 104 and is assembled with the closure 110 as part of a method described in more detail below with reference to FIGS. 14 to 21. Upon assembly, the tamper-evident member 101 fits between the base and the lid and radially outward of the spout 120. The tamper-evident member 101 includes an upper projection 105 on the upper ring 102 which projects radially inwardly and a lower flange 106 on the lower ring which projects radially outwardly.

Figure 10:
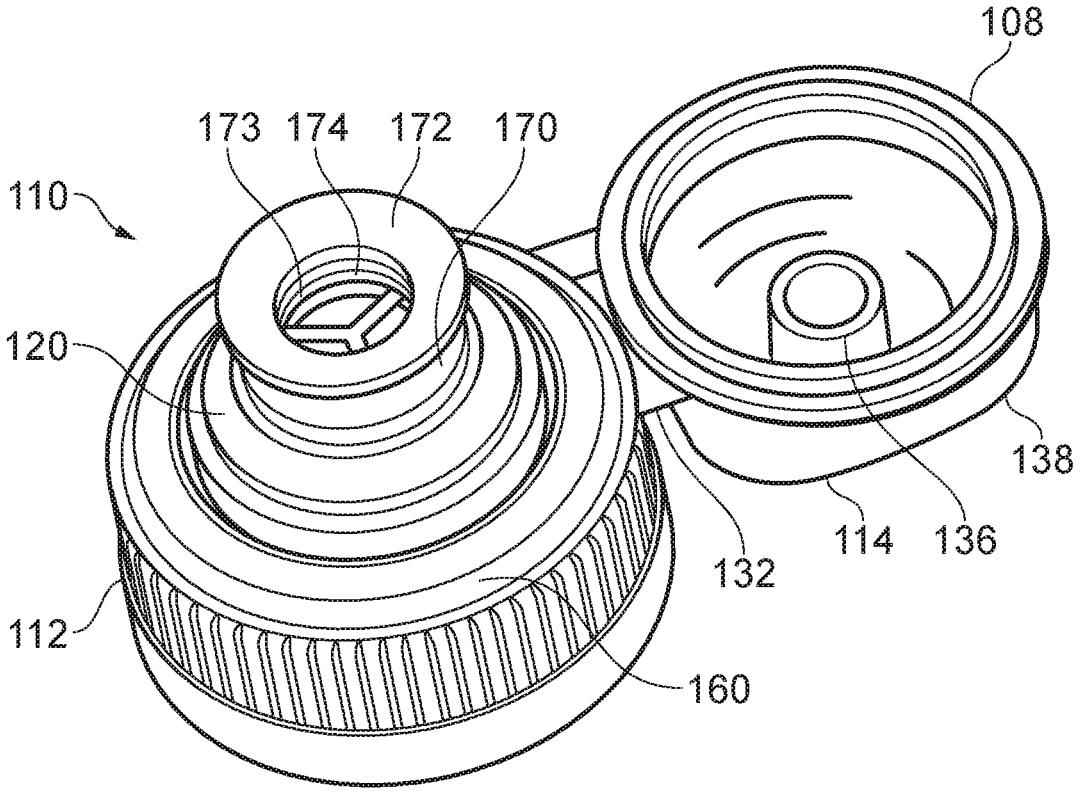
FIG. 10 is a perspective view of the closure of FIGS. 7 to 9 shown in an open position.
Figure 11:
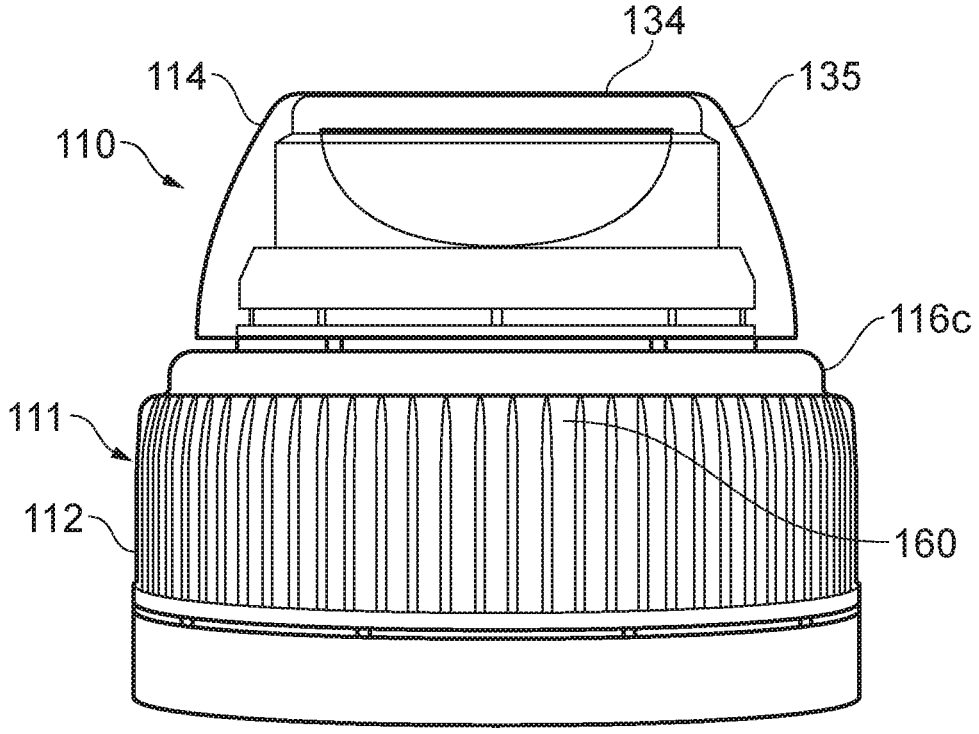
FIG. 11 is a side view of the closure of FIG. 10 after it has been re-closed.
Figure 12:
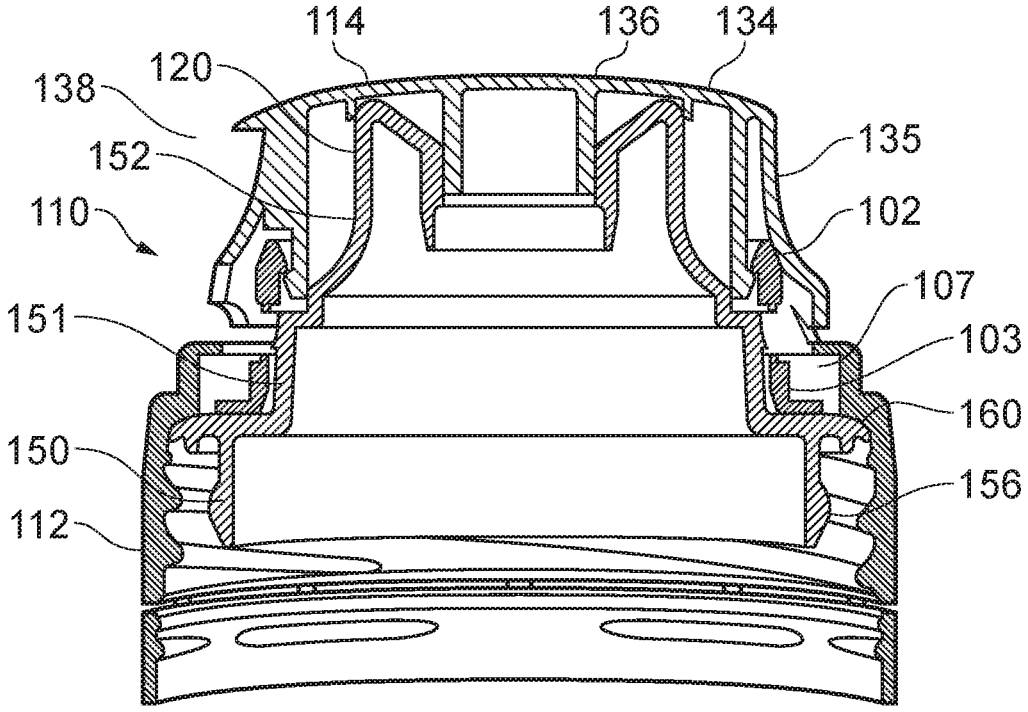
FIG. 12 is a section of the closure of FIG. 11.

When the tamper-evident member 101 is assembled with the closure 110 the upper projection 105 engages with a projection 125*e* provided on the radially inner surface of the inner skirt 125*b* of the lid. Further, the flange 106 engages with the underside of the shoulder 116*c*. In this manner, the lid cannot be opened without breaking the frangible connections 104. The member 101 splits into the two rings 102, 103 as shown in FIGS. 10 to 12 and the lower ring 103 is no longer visible through the lid window 108, having dropped into a void 107 above the spout ledge 121.

Figure 7:
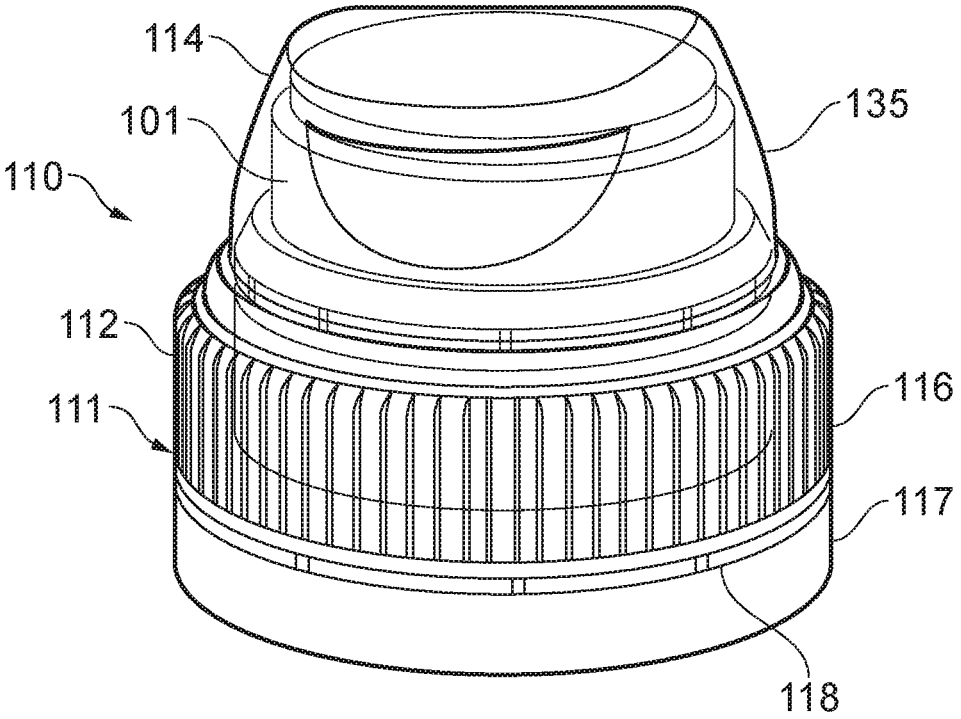
FIG. 7 is a perspective view of an alternative closure suitable for the present disclosure and shown in a fully assembled, closed position.
Figure 8:
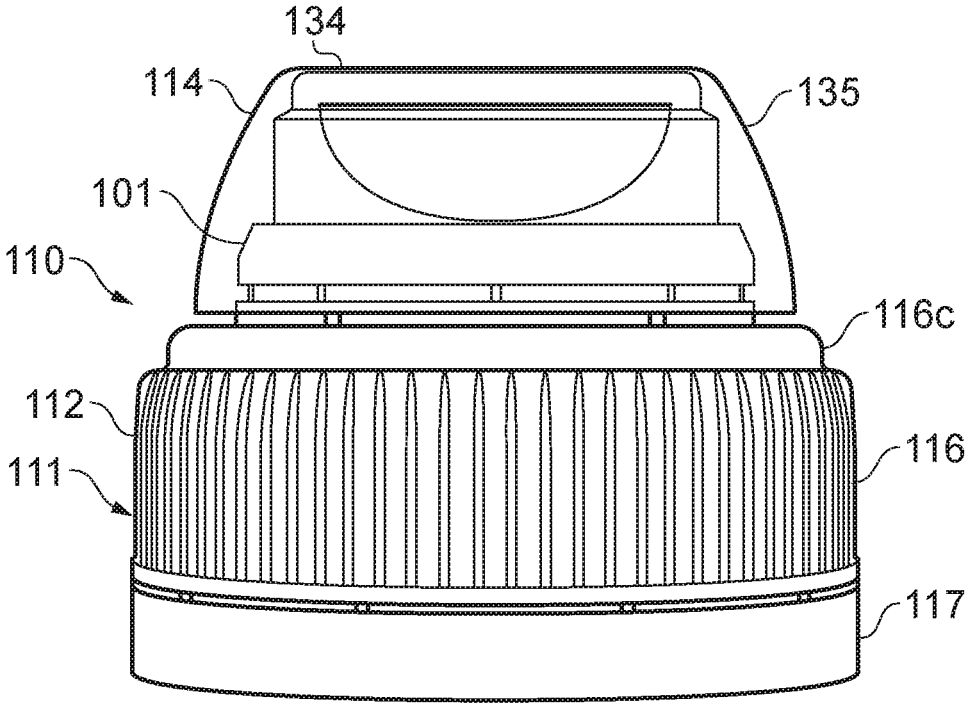
FIG. 8 is a front view of the closure of FIG. 7.
Figure 9:
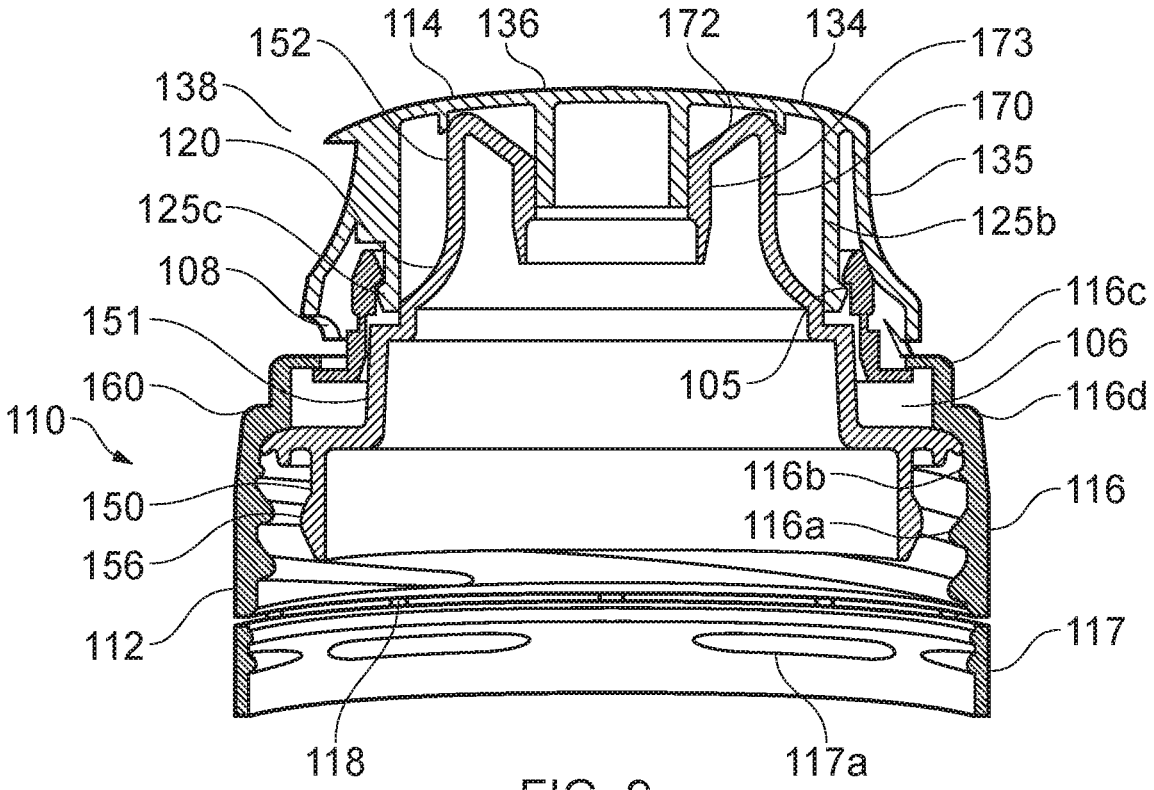
FIG. 9 is a section of the closure of FIGS. 7 and 8.

In FIGS. 7 to 9 the closure 110 is shown in the closed position. When a user desires to drink from the spout they grasp the lid and flip it open to the position shown in FIG. 11 using the peak 138.

The user can now access the spout freely and unencumbered by the lid. With the lid in the open position the ring 103 is retained in the lid by the projection 125*e* and is clearly visible in the lid. The separated rings 102, 103 show that the closure has been opened at least once.

Referring now to FIGS. 14 to 21 there is described a method of manufacturing a tamper-evident dispensing closure.

Figure 14:
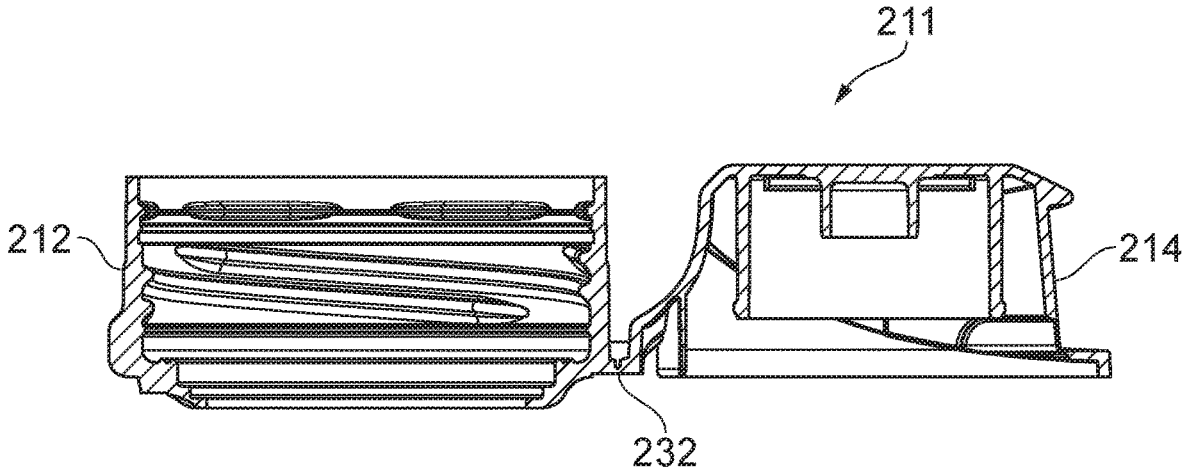
FIG. 14 is a section of a closure body in an as-moulded condition.

In FIG. 14 a closure body 211 is shown and is generally the same as that of the closures 10, 110, comprising a base 212 and a lid 214 hinged together by an integral hinge 232. In this embodiment the body is formed with the lid 214 in an open position.

Figure 15:
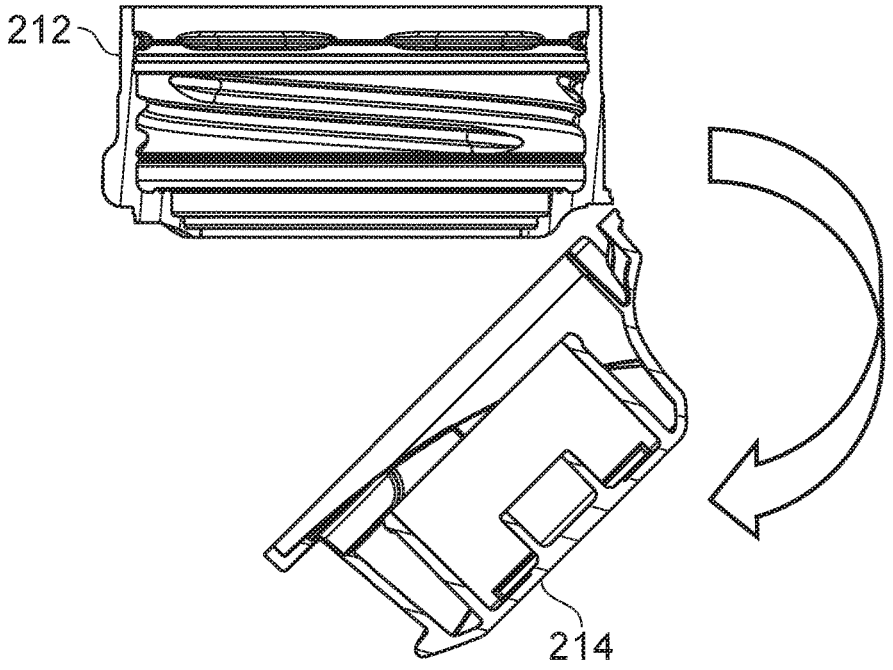
FIG. 15 shows the closure body of FIG. 14 following a pre-closing step.

FIG. 15 shows a pre-closing step, in which the lid 214 is moved to a partially closed position with respect to the base 212.

Figure 16:
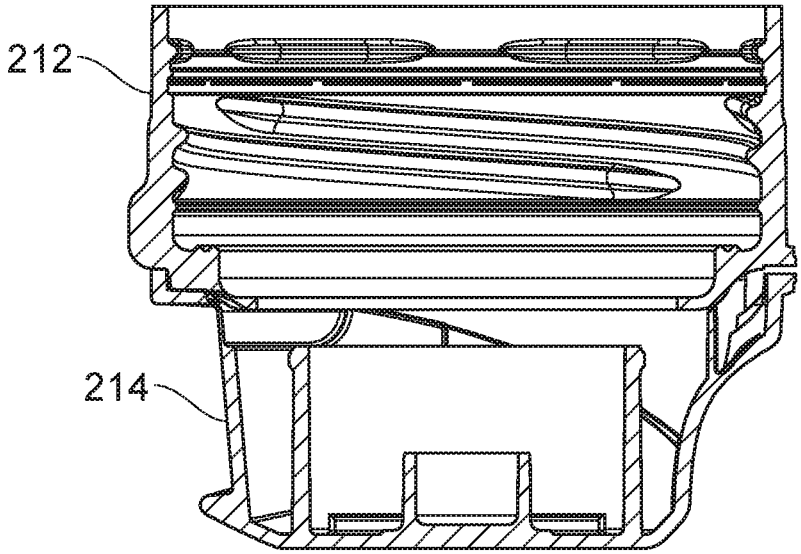
FIG. 16 shows the closure body of FIG. 15 in a fully closed position.

In FIG. 16 the lid 214 has been fully closed on to the base 212.

Figure 17:
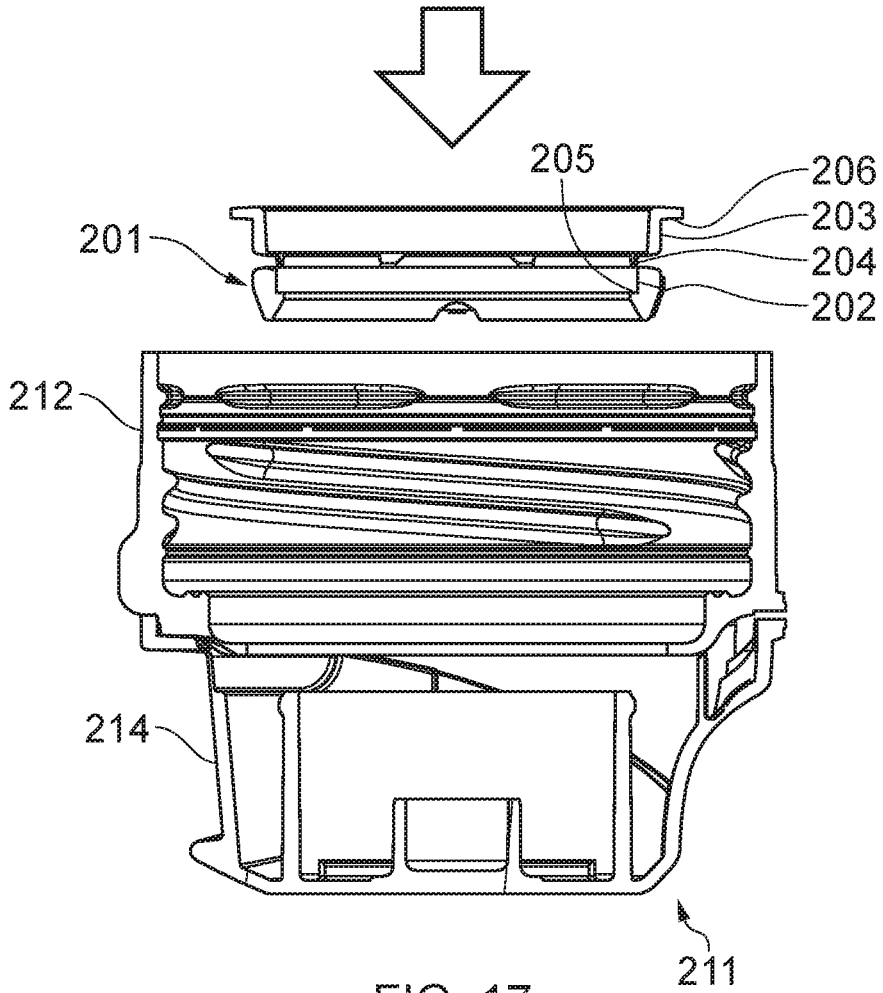
FIG. 17 shows a tamper-evident member offered up to the body of FIG. 16.

In FIG. 17 a tamper-evident member 201 is presented to the closed body 211.

The member 201 takes the form of a separate annular element having an upper ring 202 and a lower ring 203 connected together by frangible connections 204.

The member 201 includes an upper projection 205 on the upper ring 202 which projects radially inwardly to form a hook; and a lower flange 206 is provided on the lower ring 203 and projects radially outwardly.

Figure 18:
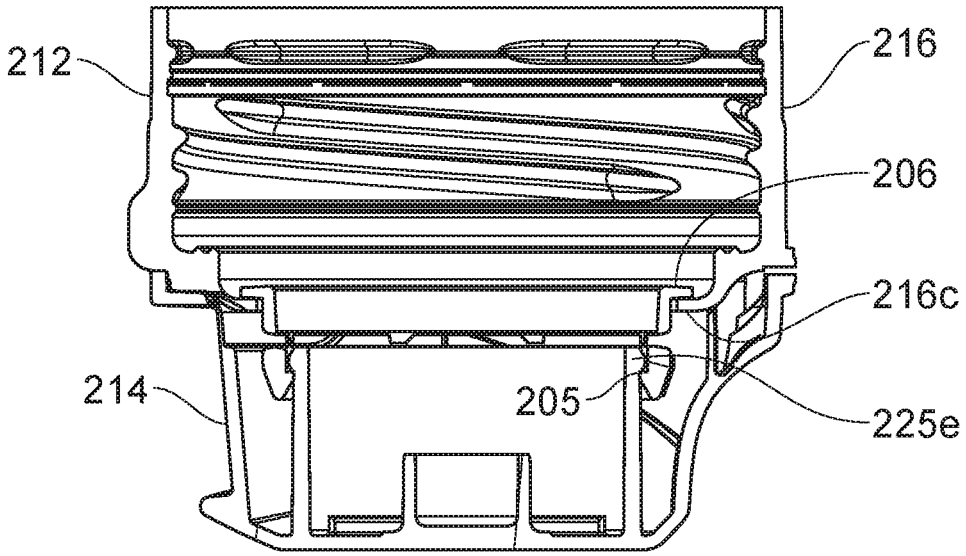
FIG. 18 shows the member of FIG. 17 inserted into the body.

In FIG. 18 the member 201 is pushed through the open end of the base sidewall 216. The member flange 206 abuts against the underside of the shoulder 216*c* and the upper ring projection 205 snaps over the lid inner skirt bead 225*e* to connect it to the lid and to hold the lid in the closed position.

Figure 19:
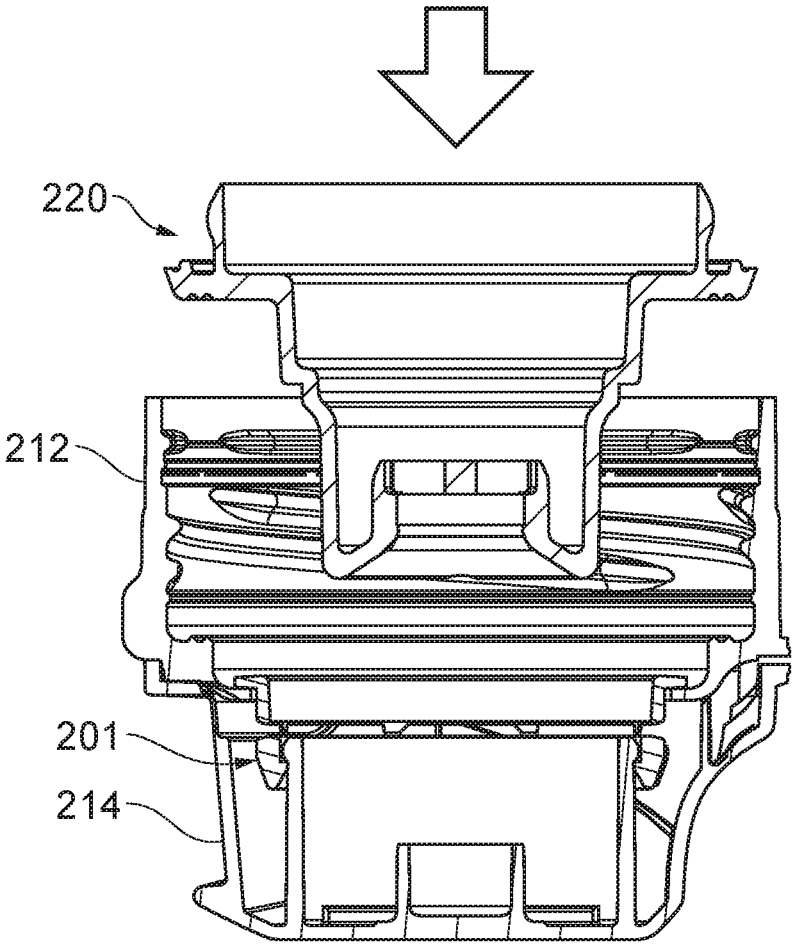
FIG. 19 shows a dispensing spout offered up to the body/member of FIG. 18.

In FIG. 19 a dispensing spout 220 is presented to the closed body (with the member 201 in position).

Figure 20:
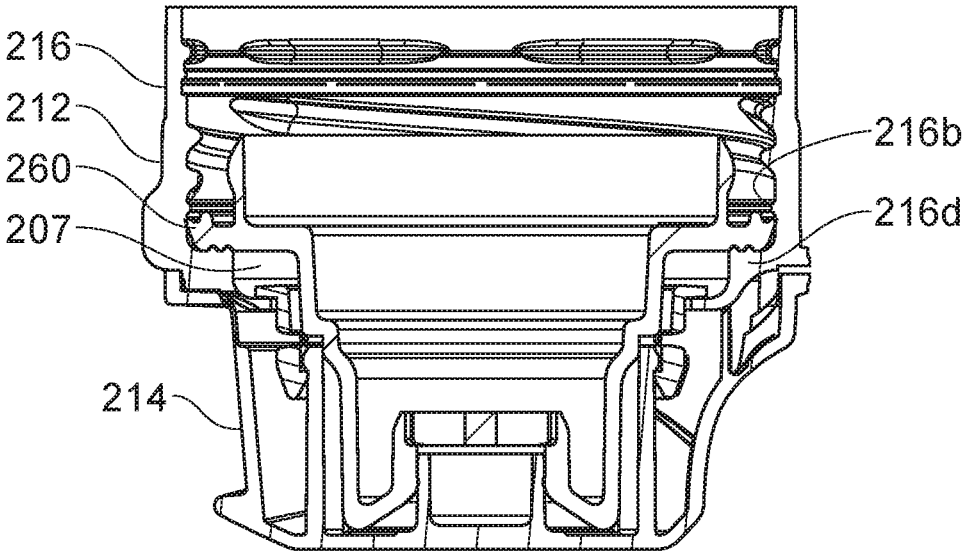
FIG. 20 shows the spout of FIG. 18 inserted into the body/member to form a fully assembled closure.

In FIG. 20 the spout 220 is pushed into the open end of the base sidewall 216.

The spokes 260 (which in other embodiments may be a continuous flange) abut against the shoulder 216*d* and engage over the projection 216*b* to retain the spout in the base. The lid spigot 236 enters through the spout wall 273 to close the orifice 274.

Figure 21:
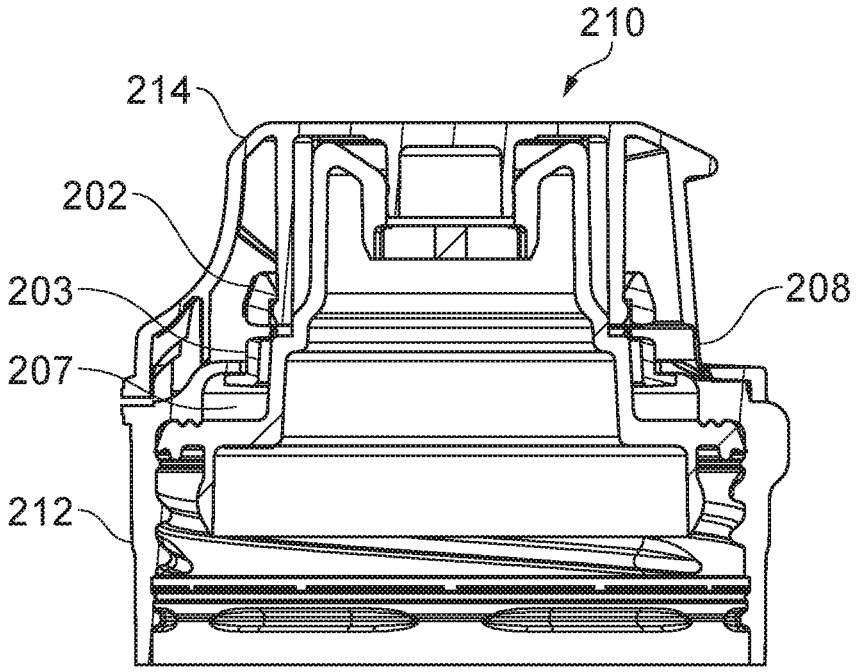
FIG. 21 shows the fully assembled closure of FIG. 20 ready for further processing or use.

The assembled closure 210 is now shown in FIG. 21. Further processing steps may now be performed, such a slitting to form a tamper-evident band at the free end of the base sidewall.

The closure 210 functions in a similar way to the closures 10, 110. Upon first opening the tamper member rings 202, 203 are torn apart because the upper ring 202 is clipped over the skirt bead 225*e* and the lower ring flange abuts against the shoulder 216*c*. The upper ring 202 is retained by the lid, and the lower ring 203 drops into the base void 207 so it can no longer be seen through the window 208.

Figure 23A:
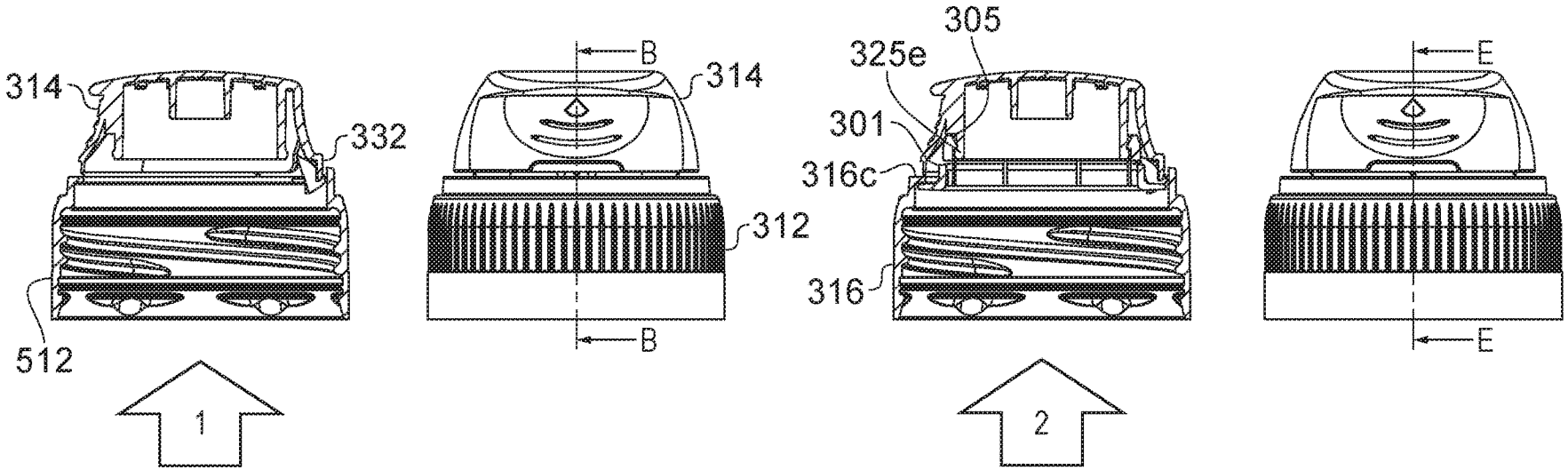
FIG. 23A is a section of the closure of FIG. 22A shown with a tamper-evident member inserted and with a spout being presented.
Figure 23A:
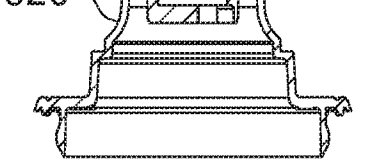

Referring now to FIGS. 22 to 24 there is described a method of manufacturing a tamper-evident dispensing closure 310 formed according to an alternative embodiment.

Figure 22B:
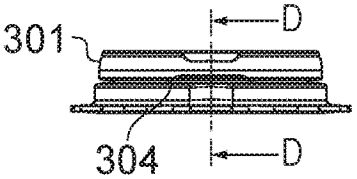
FIG. 22B is a front view of the closure body and member of FIG. 22A.
Figure 22A:
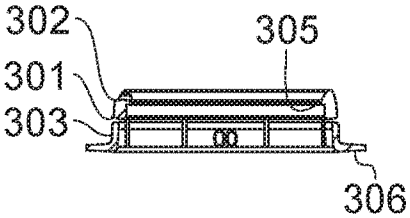
FIG. 22A is a section of a closure body formed according to an alternative embodiment and shown with a tamper-evident member being presented.

In FIGS. 22A and 22B a closure body 311 is shown and is generally the same as that of the closures 10, 110, comprising a base 312 and a lid 314 hinged together by an integral hinge 332. In this embodiment the body is formed with the lid 214 in a closed position. In other embodiments the lid is formed in an at least partially open position.

A tamper-evident member 301 is presented to the closed body 311. The member 301 takes the form of a separate annular element having an upper ring 302 and a lower ring 303 connected together by frangible connections 304.

The member 301 includes an upper projection 305 on the upper ring 202 which projects radially inwardly to form a hook; and a lower flange 306 is provided on the lower ring 303 and projects radially outwardly.

Figure 23B:
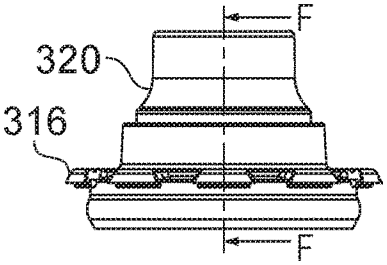
FIG. 23B is a front view of the closure of FIG. 23A.

In FIGS. 23A and 23B the member 301 has been pushed through the open end of the base sidewall 316. The member flange 306 abuts against the underside of the shoulder 316*c* and the upper ring projection 305 snaps over the lid inner skirt bead 325*e* to connect it to the lid and to hold the lid in the closed position.

A dispensing spout 320 is presented to the closed body (with the member 301 in position).

Figure 24A:
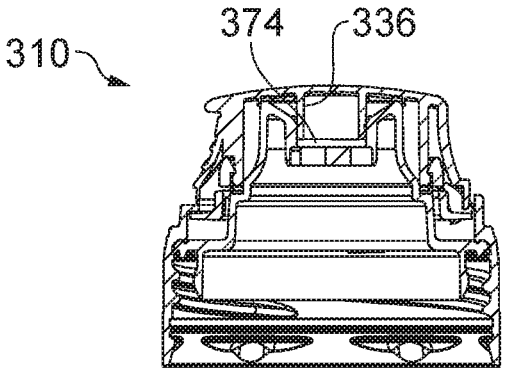
FIG. 24A is a section of the closure of FIG. 23A shown following insertion of the spout.
Figure 24B:
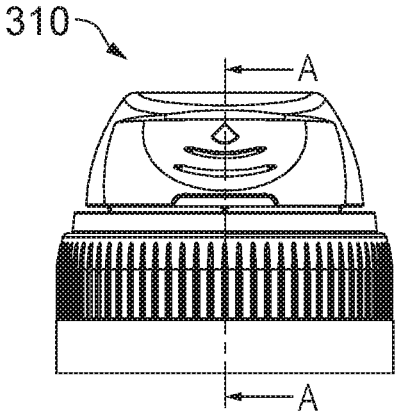
FIG. 24B is a front view of the closure of FIG. 24A.

In FIGS. 24A and 24B the spout 320 has been pushed into the open end of the base sidewall 316.

The spokes 360 (which in other embodiments may be a continuous flange) abut against the shoulder 316*d* and engage over the projection 316*b* to retain the spout in the base. The lid spigot 336 enters through the spout wall 373 to close the orifice 374.

The assembled closure 310 is now shown in FIGS. 25A to 25F. Further processing steps may now be performed, such a slitting to form a tamper-evident band at the free end of the base sidewall.

Figure 25A:
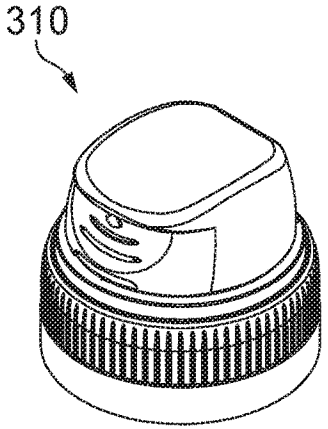
FIGS. 25A to 25F show front perspective, rear perspective, rear, side, front and top views of the fully assembled closure in a closed position.
Figure 25B:
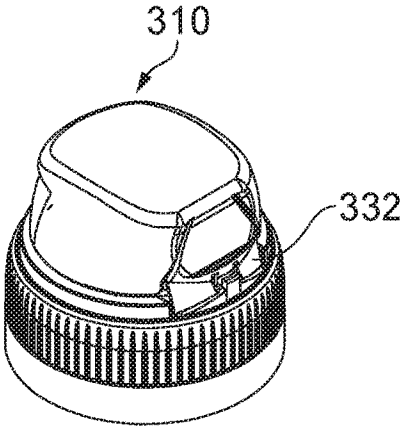
Figure 25C:
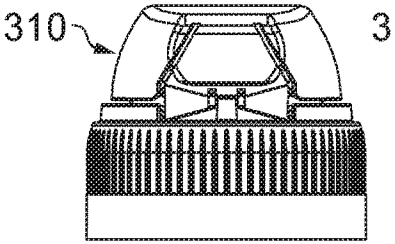
Figure 25D:
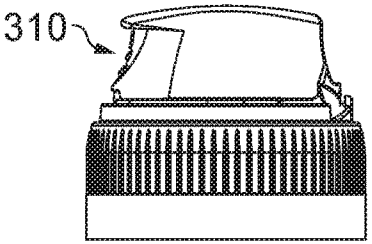
Figure 25E:
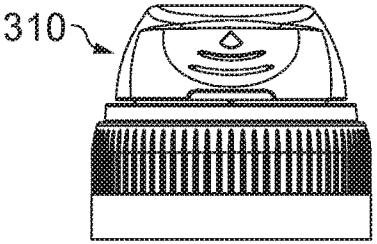
Figure 25H:
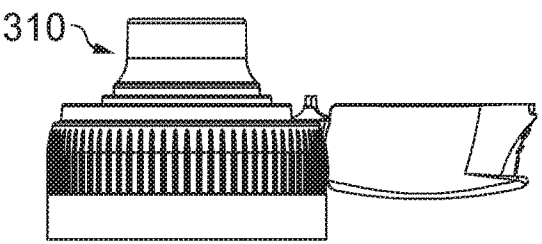
FIGS. 25G to 25I show front perspective, side and top views of the closure in an open position.
Figure 25F:
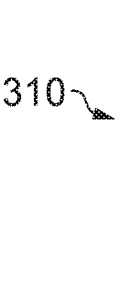
Figure 25I:
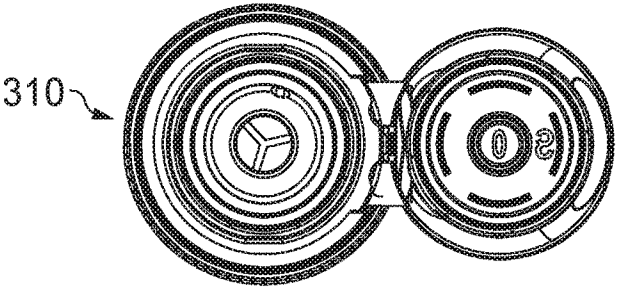
Figure 25G:
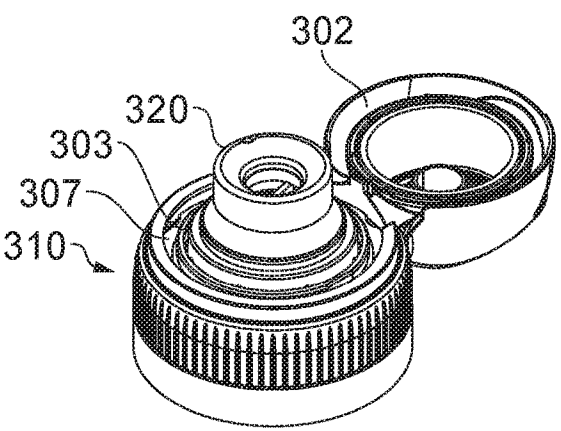

The closure 310 functions in a similar way to the closures 10, 110, 210. Upon first opening the tamper member rings 302, 303 are torn apart because the upper ring 302 is clipped over the skirt bead 325*e* and the lower ring flange abuts against the shoulder 316*c*. The upper ring 302 is retained by the lid and the lower ring 303 drops into the base void 307 so it can no longer be seen through the window 308 (see FIGS. 25G to 25I).

Although illustrative embodiments of the disclosure have been disclosed in detail herein, with reference to the accompanying drawings, it is understood that the disclosure is not limited to the precise embodiments shown and that various changes and modifications can be effected therein by one skilled in the art without departing from the scope of the disclosure as defined by the appended claims and their equivalents.

The invention claimed is:

1. A tamper-evident closure assembly, comprising:

a body having a base and a lid connected by an integral hinge;

a tamper-evident member which is a separate element to the body, the tamper-evident member comprising an upper projection which projects radially inwards and a lower flange which projects radially outwards, the upper projection engaging the lid and the lower flange engaging the base; and a dispensing spout in the body.

2. The tamper-evident closure assembly of claim 1, wherein the tamper-evident member comprises two rings frangibly connected together.

3. The tamper-evident closure assembly of claim 2, wherein one of the two rings engages in the lid and one of the two rings engages in the base.

4. The tamper-evident closure assembly of claim 1, wherein the lid includes an inner skirt, and the upper projection engages with a projection provided on the inner skirt of the lid.

5. The tamper-evident closure assembly of claim 1, wherein the base has a sidewall and the sidewall has a terminal sidewall portion, wherein the lower flange is part of a lower ring, and wherein the lower flange of the lower ring engages under the terminal sidewall portion.

6. The tamper-evident closure assembly of claim 1, wherein the upper projection includes an undercut.

7. The tamper-evident closure assembly of claim 1, wherein the tamper-evident member fits between the base and the lid and radially outward of the spout.

8. The tamper-evident closure assembly of claim 1, wherein the lid has a top surface and the lid has an outer skirt and an inner skirt which depend from the top surface, the inner skirt presses against part of the dispensing spout to provide a seal.

9. The tamper-evident closure assembly of claim 1, wherein the lid includes a top surface, an annular projection depending from an underside of the top surface which takes the form of a bore seal to seal against an inner surface of the dispensing spout to prevent leakage of contents of the container when the lid is in a closed position.

10. The tamper-evident closure assembly of claim 1, wherein the lid has a top surface and a projection on one side to aid gripping and opening of the lid.

11. The tamper-evident closure assembly of claim 1, wherein a void or pocket is provided between the dispensing spout and the base.

12. The tamper-evident closure assembly of claim 1, wherein the lid includes a small peak opposite the integral hinge, the small peak used to lift the lid and flip it open with respect to the base.

13. The tamper-evident closure assembly of claim 1, wherein the lid comprises a top plate from which depends a curved outer sidewall, an inner skirt depends from an underside of the top plate, radially inwards of the outer sidewall, and a spigot depends from the underside of the center of the plate, radially inwards of the inner skirt.

14. The tamper-evident closure assembly of claim 1, wherein the lid includes a sidewall and the free end of the lid sidewall includes a window.

15. The tamper-evident closure assembly of claim 14, wherein the window is a material thinning or an opening.

16. The tamper-evident closure assembly of claim 1, wherein upon first opening of the lid the tamper-evident member splits into two rings, an upper ring and a lower ring, where the upper ring is retained in the lid and the lower ring is retained in the base.

17. The tamper-evident closure assembly of claim 1, wherein the lid has a window and the base has a void, in an unopened position the tamper-evident member is visible through the window, and upon first opening a lower ring drops into the void, and the lower ring is no longer visible through the window.

18. The tamper-evident closure assembly of claim 1, wherein the upper projection and the lower flange extend completely around a circumference of the spout.

* * * * *